United States Patent [19]

Mydans

[11] Patent Number: 4,719,934

[45] Date of Patent: Jan. 19, 1988

[54] STABLE LIGHTWEIGHT SHELTER STRUCTURE

[76] Inventor: David Mydans, 462 Greenwich St., New York, N.Y. 10013

[21] Appl. No.: 840,031

[22] Filed: Mar. 17, 1986

[51] Int. Cl.[4] ..... E04H 15/16; E04H 15/40; E04H 15/32

[52] U.S. Cl. ..... 135/90; 135/102; 135/104; 135/905; 52/222

[58] Field of Search ..... 135/90, 99, 101, 102, 135/104, 901, 902, 905; 52/222

[56] References Cited

U.S. PATENT DOCUMENTS

| | | | |
|---|---|---|---|
| 844,632 | 2/1907 | Thompson | 135/101 X |
| 1,057,628 | 4/1913 | Eberhardt | 135/99 X |
| 1,658,214 | 2/1928 | Thomas | 135/90 X |
| 1,672,338 | 6/1928 | Lillesö-Peterson | 135/99 X |
| 2,263,867 | 11/1941 | Barnard | 135/90 |
| 2,656,844 | 10/1953 | Kreuzer | 135/90 X |
| 3,057,119 | 10/1962 | Kessler | 52/222 |
| 3,058,550 | 10/1962 | Richter | 52/222 |
| 3,146,784 | 9/1964 | Silver | 135/90 X |
| 3,394,720 | 7/1968 | Moss | 135/104 |
| 3,406,698 | 10/1968 | Hutchison | 135/99 X |
| 3,849,953 | 11/1974 | Cohen | 52/222 X |
| 3,921,349 | 11/1975 | Kolozsvary | 52/222 X |
| 3,970,096 | 7/1976 | Nicolai | 135/14 V |
| 4,165,757 | 8/1979 | Marks | 135/1 R |
| 4,198,997 | 4/1980 | Miller | 135/90 |
| 4,236,543 | 12/1980 | Moss | 135/3 R |
| 4,308,883 | 1/1982 | Malone | 135/90 |
| 4,467,571 | 8/1984 | Logan | 52/63 |
| 4,597,401 | 7/1986 | Fournier | 135/90 |

FOREIGN PATENT DOCUMENTS 1603210 11/1981 United Kingdom ..... 135/104

OTHER PUBLICATIONS

The Light Dimension, Early Winters Ltd. Catalog, Seattle, Wash. 1977.

Ted P. Eugenis, "Good Things in Small Packages," *Backpacker*, vol. 12, No. 1, Issue 60, Jan. 1984, pp. 62–67, 75, 81.

*Primary Examiner*—Robert A. Hafer
*Assistant Examiner*—D. Neal Muir
*Attorney, Agent, or Firm*—Sixbey, Friedman & Leedom

[57] ABSTRACT

A lightweight, portable shelter structure is provided having an aerodynamically stable configuration which is particularly resistant to wind loads. The stability of the shelter structure results from the construction of the canopy portion wall panels and their interaction with the rod members of the shelter. The canopy portion is formed of an elastic material so that the base of the canopy panel may be stretched to tension the rod members, which are formed of a resilient, flexible material. In a preferred embodiment, the canopy panel has a triangular configuration, and the rod member is secured at the base and at the apex of the triangle so that when the base is stretched, compressive forces are exerted on the rod member causing it to bow. The canopy of the present shelter structure includes at least two panels of this construction and the shelter further includes a loose, expandable floor portion attached to the canopy portion. An arrangement of ventilating structures creates air flow through the shelter and effectively reduces condensation. The stressed wall panel of the present invention may also be used in other applications where an aerodynamically stable, stressed panel is required.

15 Claims, 6 Drawing Figures

STABLE LIGHTWEIGHT SHELTER STRUCTURE

TECHNICAL FIELD

The present invention relates generally to lightweight structural panels and particularly to a stable shelter structure constructed from lightweight structural panels.

BACKGROUND ART

The increased popularity of such outdoor sports as hiking, bicycling and mountaineering has resulted in the proliferation of a variety of shelter structures which enable the participants in these sports to enjoy them for lengthy periods of time in locations which may be quite remote from conventional shelter. The ideal shelter structure for the aforementioned activities must be sufficiently lightweight and portable to be carried readily from one location to another as well as easy to assemble and disassemble and must be adaptable to a wide variety of environmental conditions. Once assembled, the ideal shelter structure must be stable enough to resist wind loads such as are particularly likely to be encountered at high mountain elevations and other environmental stresses. In addition, adequate ventilation of the shelter is essential, and the largest amount of floor space and head room possible in such a structure is highly desirable for the comfort of the shelter occupant or occupants. The ideal shelter will also be very lightweight and easily carried in a back-pack, yet will provide a large enough floor area to accommodate comfortably the occupants and their gear.

The shelter structures proposed by the prior art, while lightweight and portable, generally suffer from a number of disadvantages, the major of these being their lack of stability and their inability to shed wind loads and thus prevent the shelter structure from shifting its position. In addition, many prior art structures do not provide either optimum ventilation or interior space for the shelter occupants.

Prior art structures usually require anchoring stakes or external guy wires to stabilize them and secure them to the ground. The double walled structure disclosed by Moss in U.S. Pat. No. 4,236,543 is disclosed to hold its shape and maintain stability without staking or guy lines because the opposing side walls are held tense by resiliently flexible pole members held in a flexed condition by tunnels affixed to peripheral portions of the side walls. However, this arrangement, while more stable than many prior art structures, does not distribute stress evenly over the structure side walls and thus is not as effective in shedding wind loads and preventing shifting of the structure during high wind conditions without the attachment of external guy lines as is desirable. Further, the flat sidewall of the Moss tent yields an "A" frame profile which substantially reduces the interior volume, and the relationship between the weight and floor space area provided by the type of structure disclosed by Moss renders it heavier and smaller than desirable for many mountain climbers, backpackers and bicyclists.

The adequacy of ventilation is another problem which prior art shelter structures have not adequately addressed. Structures intended for use as shelter and protection from adverse weather must necessarily be weathertight so that the shelter occupants are, in fact, protected from the elements. However, while protecting the occupants, such a shelter must also deal effectively with condensation which forms on any surface whose temperature is below the dew point of the ambient air. Providing both adequate protection in untoward weather conditions and adequate ventilation is essential for the comfort and safety of the shelter occupants. However, the "chimney" type ventilation arrangement found in some prior art tent designs does not fully address these concerns. Prior art tent and shelter designs typically provide a double wall construction, wherein the exterior wall or fly is made from a waterproof material, for protection of the shelter occupant in bad weather. Such a shelter is disclosed in U.S. Pat. Nos. 3,790,096 to Nicolai; 4,165,757 to Marks; and 4,236,543 to Moss. This construction, however, does not eliminate the condensation which is likely to form inside the fly as a result of inadequate ventilation of the fly during bad weather. In addition, the separate fly structure may add significantly to the weight of shelter, which is a serious concern to many backpackers.

The prior art, therefore, has failed to provide a lightweight, portable, well-ventilated shelter structure having a sufficiently large amount of both floor space and head room for more than one occupant as well as an extremely stable aerodynamic configuration which is able to withstand adverse environmental conditions.

DISCLOSURE OF INVENTION

It is a primary object of the present invention, therefore, to provide a lightweight, portable shelter structure having a stable aerodynamic configuration which sheds wind loads and resists shifting.

It is another object of the present invention to provide a lightweight, portable shelter structure with single wall construction suitable for use in a variety of adverse environmental conditions, which avoids the condensation problems associated with prior art structures.

It is another object of the present invention to provide a lightweight, portable shelter structure having a large floor space to weight ratio.

It is still another object of the present invention to provide a lightweight, portable shelter structure with a ventilation system which provides for the flow of outside environmental air into and through the shelter structure to effectively control condensation.

It is yet another object of the present invention to provide a lightweight, portable shelter structure wherein the ratio of the floor area to the height of the structure can be varied by the shelter occupants to suit their needs.

It is a further object of the present invention to provide a prestressed structural panel which may be used to form the walls of a portable lightweight shelter structure and in a variety of other end use applications.

The foregoing objects are achieved by providing a lightweight, portable shelter structure including at least two tensioned wall panels which forms a taut canopy portion and a loose, expandable floor portion, wherein the floor area is less than the canopy area. The tensioned wall panels interact with at least two flexible rod members so that the panels place the rod members under stress. Each of the wall panels is substantially triangular in configuration and has a longitudinal base portion and an apex, wherein the rod member is substantially contiguous with a chord extending from a point on the base portion along the height of the triangle to the apex. As the shelter structure is assembled, the length of the base portion of each wall panel is increased by stretching it in a direction parallel to the base, which causes height of the triangle to decrease, resulting in the application of compressive forces to the flexible rod member. The flexible rod member is thereby placed under stress and caused to bow. At least two such wall panels are joined together along one of the sides or along the base of the triangle to form the canopy portion of the shelter. When the shelter is fully assembled, the wall panels are connected to the floor portion, which is loose and baggy in contrast to the taut canopy portion. The loose floor portion includes a pleated foot section which expands readily as needed to provide ample space for at least two occupants and their gear and which is loose enough to go over any obstructions, such as rocks and the like, which might be encountered on the site where the shelter is to be erected. The shelter further includes ventilation means for allowing the flow of outside air into and through the interior of the shelter, including a system of vents positioned to allow dry, ambient air to enter the shelter interior at a location near the floor portion and warm moist interior air to escape from the shelter interior at a location near the highest point of the canopy portion. Anchor means are provided to secure the shelter structure to the ground or to environmental objects, such as trees and the like, and to provide added stabilization.

The present invention additionally provides a lightweight prestressed structural panel of substantially triangular configuration having a base and an apex, wherein a flexible rod member is positioned at a point on the base to extend perpendicularly substantially along the height of the triangle from the base to the apex. As the material forming the panel is stretched so that the length of the base increases, the distance from the base to the apex and the height of the triangle are decreased, thereby causing the rod member to be deflected from a straight to a curved configuration as a result of the compressive force applied by the panel material to the rod. The stressed panel thus formed will be useful as a versatile structural building component.

Other objects and advantages will become apparent from the following description, drawings and claims.

BEST MODE FOR CARRYING OUT THE INVENTION

The present invention provides a uniquely stressed structural panel which may have a number of end use applications. The preferred embodiment for the present structural panel is a lightweight, portable shelter structure which folds compactly into a small package so that it may be easily carried in a backpack and erected quickly to provide shelter in a variety of environmental conditions. The shelter structure disclosed herein is extremely stable and able to resist wind loads such as those found at high altitudes without shifting or other adverse effects to the shelter or to its occupant. Moreover, the loose, expandable floor portion provides a great deal of flexibility to the shelter occupants in permitting them to vary the height and width of the shelter as needed to accommodate them and their gear comfortably. It is the configuration of the canopy portion, however, that primarily determines the stability and wind resistance of the shelter.

Figure 1:
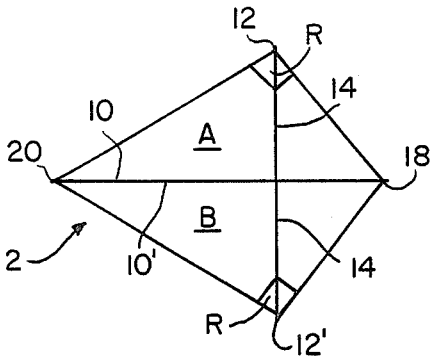
FIG. 1 is a top diagrammatic view of one configuration for the canopy of the present shelter structure.
Figure 2:
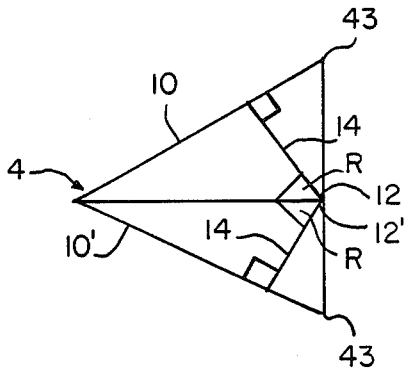
FIG. 2 is a top diagrammatic view of a second configuration for the canopy of the present shelter structure.

Two possible canopy portion configurations 2 and 4 are illustrated in FIGS. 1 and 2. Each configuration includes two triangular contiguous sections A and B which ultimately form the wall panels of the canopy when the shelter is assembled. The primary distinction between the two configurations lies in the orientation of the base 10 of triangle A relative to the orientation of the base 10' of the triangle B and the positioning of the flexible rod members which support the shelter canopy above the floor portion. Triangles A and B are right triangles, and each includes a right angle R opposite the base at an apex 12, 12'. In the canopy configuration shown in FIG. 1, the base 10 of triangle A is positioned so that it is contiguous with the base 10' of triangle B, which results in the right angles R being opposite each other and the canopy 2 having an overall irregular rectangular configuration. In FIG. 2, however, triangles A and B are positioned so that the right angles R are adjacent to each other and the bases 10 and 10', respectively, are substantially opposite each other. The canopy 4 of this embodiment, therefore, has an overall triangular configuration. Each different canopy configuration will require a somewhat different front access panel and opening as will be explained in detail hereinbelow.

Whichever canopy configuration is selected, each triangle A and B will interact with a flexible rod member 14 to create a stressed or tensioned wall panel. A flexible rod member 14 is positioned and held in place on each wall panel along a line approximating the height of each triangle (A, B) so that member 14 extends from the base (10, 10') to the apex (12, 12'). Each flexible rod member 14 may be held in place at this location either on the inside or the outside of the canopy by any attachment or positioning means which will maintain the flexible member in place. For example, mating Velcro strips may be provided at spaced intervals along the rod member 14 and canopy or a sleeve which completely encloses the rod member may be employed as discussed hereinbelow in connection with FIGS. 5 and 6. Whatever attachment or positioning means is chosen must hold the flexible member 14 securely in place so that it will remain in place when the wall panel is stressed during and after assembly of the shelter.

Figure 3:
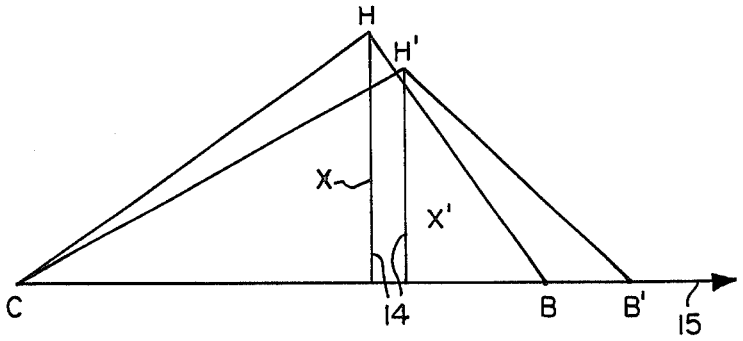
FIG. 3 is diagrammatically illustrates the stressed panel of the present invention.

FIG. 3 diagrammatically demonstrates the formation of the stressed panel of the present invention. Triangle CBH represents a wall panel in an unstressed condition. The flexible rod member 14 is placed along a line contiguous with height X. As the base CB is increased in the direction of the arrow 15, triangle CB'H' having height X' is formed. Height X' is less than height X due to the compressive forces which are applied in a direction parallel to X when CB is increased to CB'. Since rod member 14 is secured along height X, these compressive forces will force rod member 14 to be stressed to a curved condition to conform to the shorter length of the new height of the wall panel, X', imparting to the panel a smooth, curved shape.

The provision of a right angle R at the apices 12, 12' of triangles A and B, respectively in FIG. 1, has been found to impart an enhanced stability to the shelter structure without the need for additional stabilizing means thereby also reducing the weight of the shelter. When the shelter canopy wall panel material is stretched along the bias as described there will be little or no stretch along the sides stabilized by the grain of the fabric. An additional benefit of providing a right angle R for each triangle is the greatly simplified cutting and shelter construction which results. Fabric waste may be significantly reduced because of the efficient placement of wall panel patterns which is possible with a right angle triangle configuration.

The material selected for the canopy portion of the present shelter must be waterproof and weather resistant so that a single layer will protect the shelter occupants and contents from adverse weather. The ideal material will also be lightweight and elastic and capable of "breathing" to minimize condensation in the interior of the shelter. Optimum materials include those marketed under the GORE-TEX®, ENTRANT® or BION II® trademarks. A coated nylon, however, can be employed even though it does not breathe, because the shelter's flow-through ventilation system effectively minimizes condensation inside the shelter in a manner which will be explained in detail hereinbelow.

Triangles A and B are preferably cut as separate pieces and joined as shown in FIGS. 1 and 2 to form canopy configurations 2 and 4, respectively. The entire canopy, however, could be cut as a single, unitary sheet having the overall configuration shown in either FIG. 1 or FIG. 2 or in four or more pieces to allow the pole sleeve to be inserted in a seam or simply to accomodate a larger size. Employing at least two triangular sections like triangles A and B will allow a more efficient use of the canopy fabric, although a seam will be required to join the two sections. Any appropriate method of joining the material chosen for the canopy along the seam can be used, such as stitching, so long as the seam in FIG. 1 remains elastic. It is desirable to apply a seam sealant material to ensure that the seam is fully waterproof and weathertight.

It is desirable to apply some type of stabilizing means to particular areas along the perimeter of the canopy portion both to reinforce the grain of the canopy fabric and to impart stability to those portions of the canopy perimeter which will be attached to other parts of the shelter, such as the floor or an access panel, as will be described in detail hereinbelow. A bias-type tape which is compatible with the canopy fabric is the preferred stabilizing member.

Figure 4:
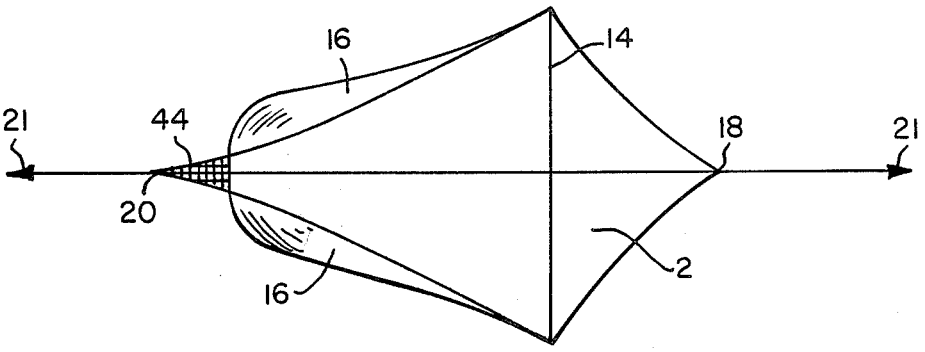
FIG. 4 is a top plan view of the present shelter structure.

In contrast to the canopy, which is held stretched in a taut condition and maintains the flexible rod members 14 under tension when the shelter is fully assembled, the floor portion 16 of the shelter is formed from an excess of material so that it is loose and baggy and is expansible beyond the perimeter of the canopy. FIG. 4 illustrates, in top plan view, the baggy floor portion 16 relative to the taut canopy portion 2 of the embodiment shown in FIG. 1. In FIG. 4 the canopy portion has the configuration described in connection with FIG. 1, and the flexible rod member 14 is held in place as shown. The canopy is stretched taut and maintained in this condition in a manner which will be explained in more detail hereinbelow by the attachment of points 18 and 20 of the canopy to suitable guy lines, supports and/or anchor structures. The floor portion 16, in contrast, is neither stretched nor held in a taut condition, but is pleated or gathered prior to attachment to the canopy.

There will be more floor material to be gathered for attachment to the canopy portion in the area of point 20 than in the area of point 18 because of the canopy configuration. This allows the floor 16 to be expanded outwardly of the canopy perimeter to provide increased foot space and storage room over that which would be provided if the floor portion simply covered the area within the confines of the canopy perimeter. One result of providing this baggy, expansible floor portion is that a shelter or tent constructed in this way having a relatively small canopy structure can comfortably accommodate two occupants with sleeping bags and gear.

Figure 5:
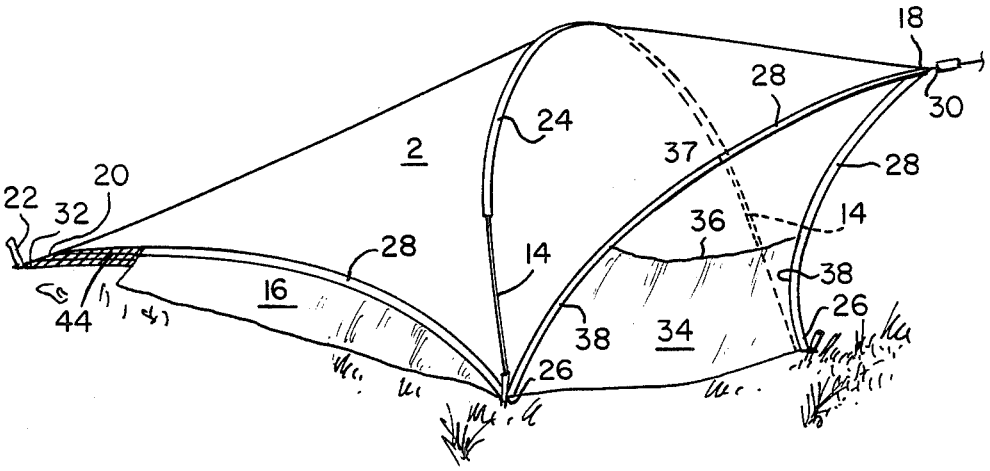
FIG. 5 is a side perspective view of the present shelter structure.
Figure 6:
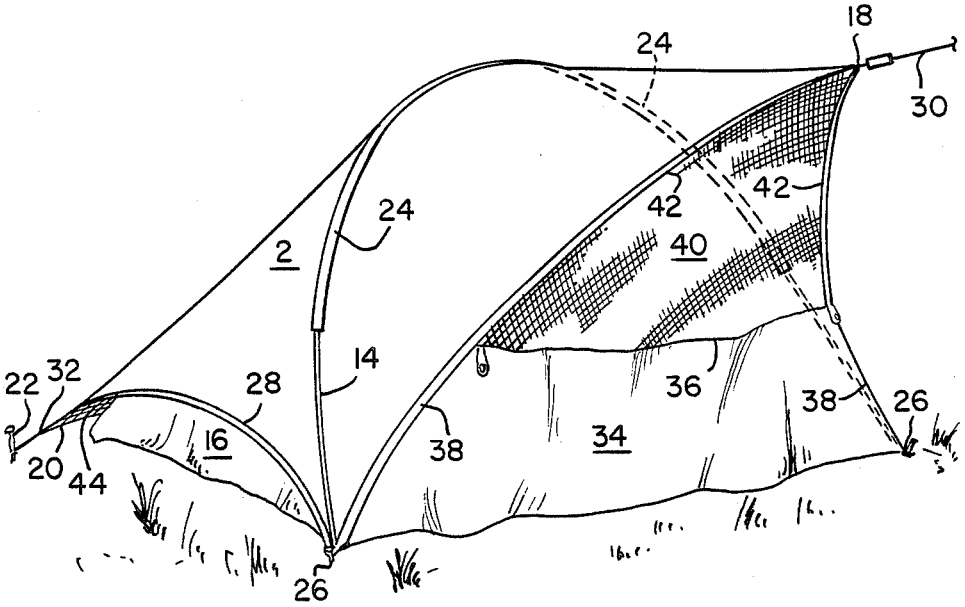
FIG. 6 is a front perspective view of the present shelter structure.

The shelter of the present invention is shown from two different perspectives in FIGS. 5 and 6 in a fully assembled state. FIG. 5 shows the shelter in a side perspective view, and FIG. 6 shows the shelter in a front perspective view. The back end 20 of the canopy is secured to an anchor structure 22. A stake which may be driven into the ground will be most often used as an anchor, but other suitable structures may also be used. The forward or front end 18 of the canopy is also secured to a suitable support (not shown) preferably at a distance above the ground which corresponds approximately to the interior height selected for the shelter. End 18, for example, may be tied to a tree, if one is available, or a separate support pole (not shown) may be employed. Such a support is commonly referred to as an "I" or "A" pole.

The canopy portion 2 includes rod attachment means which function to secure the rod members 14 to the canopy fabric. The rod attachment means can take the form of sleeves or channels 24 through which the rod members may be inserted, as shown in FIG. 5. Such a sleeve may encase each rod member completely or only partially, as shown. However, the rod attachment means may also be formed from a variety of structures and from materials which will removably secure the rod members 14 to the canopy portion of the structure so that the rod members will remain in place substantially coincident with a line corresponding to the line formed by both rod members 14 in FIG. 1 and chord X in FIG. 3 when the canopy is stretched taut in the directions of the arrows 21 in FIG. 4. The rod attachment means may, moreover, be located on either the interior or the exterior of the canopy. When canopy points 18 and 20 are properly secured in place, the rod members 14 are stressed by the canopy portion of the structure, which places these members under tension and causes them to bow outwardly, thus creating the rounded canopy configuration shown in FIGS. 5 and 6. This is an especially desirable canopy configuration since it provides significantly more interior room for the shelter occupants than a typical A-frame shaped tent shelter does.

The rod members 14 should be formed from a flexible, yet durable, material which will permit the rod members to be repeatedly stressed as described. However, the material should also be sufficiently lightweight so that the rod members do not add significantly to the total weight of the shelter structure, which should be light enough to permit it to be carried in a backpack. The rod members 14 are preferably hollow, formed of a plurality of sections and made of a lightweight aluminum or similar material. A single elastic cord of the type commonly referred to as "shock cord" threaded through each section provides flexibility while permitting the rod members to be stressed and maintained under tension, yet allows the sections to be disengaged, collapsed and folded to a convenient length.

If desired, a snap and grommet attachment or the like (not shown) may be provided for the end of each rod member at canopy points 26 to secure the pole end to the canopy. A reinforced pole foot (not shown) may also be provided to receive the end of each rod member 14 and protect the canopy and floor from damage by the ends of the rod members. The extent to which the rod members are bowed outwardly will depend on the tension created by stretching the canopy along the base of its panels. Guy cord 30 can be used to vary this tension and, therefore, the height of the arc created by the bowed rod member. The shelter occupants can thus easily vary the height to width ratio of the shelter interior by adjusting tension at guy cord 30.

The baggy floor portion 16 of the shelter enhances the adaptability of the structure. Because it is loose and expansible and not taut as in prior art shelters, it provides the shelter occupants with more interior shelter room. In addition, the shelter can be assembled and erected on rough terrain where the loose floor will easily fit over obstructions which would prevent the erection of prior art structures having taut floor portions. The floor portion 16 includes a protective sill 34 which extends upwardly from the floor portion 16 toward canopy point 18, leaving an opening 37 in the front of the shelter to provide ingress and egress for the occupants. The upper edge 36 of the sill 34 is fitted with a shock cord to maintain position and attached to various door and netting means 40 used to close off the opening 37 as protection against wind, precipitation, or insects. It is preferred to include a closure means (not shown) such as zippers or Velcro along the sides 42 of both the door and netting means 40 and the canopy 2. The door and netting means may then be easily closed off against the elements or opened to allow the occupants to leave or reenter the structure. The configuration of the sill and door and netting means will be different from that just discussed for the shelter embodiment shown in FIG. 2. In addition, anchor means may be provided at points 43 for this embodiment to assist in stabilizing the structure.

The shelter of the present invention provides significantly improved ventilation for the occupants than does prior art structures. As a result, condensation in the interior of the present shelter is substantially reduced. A protected ventilator 44 is positioned to extend adjacent to canopy portion point 20 to the floor portion 16 to allow cool, dry outside air to enter the shelter at the rear end. The front end of the structure, which has been described hereinabove, includes opening 37 through which warm, moist interior air can flow out of the shelter. The relative positions of the ventilator 44 and opening 37 creates a ventilation pattern which directs the air flow up through the shelter. The air flow thus achieved is significantly more efficient than the ventilation employed in prior art structures and effectively reduces condensation in the shelter interior. Sufficient protection is provided to ventilator 44 and opening 37 by the canopy configuration when the shelter is in its assembled position (FIGS. 5 and 6) and the canopy portion 2 is stretched to stress the rod members 14 that the shelter can be used in almost any weather. When the canopy point 18 is secured to a suitable anchor, a protective hood is formed which extends outwardly beyond the front floor portion to provide a covered area directly over the opening 37. This arrangement permits adequate air flow for ventilation while providing the kind of protection from the environmental elements usually unavailable in a small, lightweight shelter which can be used almost year around.

Preferably, the shelter has a finished floor width of about 60 to 84 inches and a height of about 38 to 42 inches when it is assembled. However, as discussed above, the shelter occupants can vary the height to width ratio simply by adjusting the tension of guy cord 30 on the rod members 14. The present shelter, therefore, provides the occupants with more interior room than prior art shelters of a similar size and with the flexibility to vary that room to suit the needs of the occupants or the demands of the weather.

Although the present invention has been described with respect to a preferred embodiment, the principles which resulted in the formation of this extremely stable, wind resistant shelter structure may also be applied to form structural panels for other purposes. For example, this aerodynamically streamlined stressed panel may be employed in the construction of a lifting wing such as is used in the sport of hang gliding. Such a lifting wing would also resist wind loads and provide the degree of stability achieved by the above-described shelter structure.

INDUSTRIAL APPLICABILITY

The stressed structural panel of the present invention will find its primary application in the construction of an extremely stable, lightweight, portable shelter structure suitable for use in remote locations under a variety of environmental conditions. This stressed structural panel may also be employed whenever a strong, lightweight, aerodynamically stable structural panel is required.

I claim:

1. A structural panel including elastic wall means having a substantially triangular configuration including a base and an apex; further including a flexible rod member extending between said base and said apex, secured by a securing means to said wall means between said base and said apex, wherein the longitudinal extent of said base and said elastic wall means adjacent said base is increased by the application of a linear force to said base in a direction parallel to the longitudinal extent of said base, thereby decreasing the distance between said base and said apex so that said wall means applies a compressive force to said rod member causing said rod member to bow in a direction orthongonal to the direction of said compressive force, said securing means deflecting said elastic wall means corresponding to said rod member bow and further including means for maintaining said linear force.

2. A lightweight, portable shelter structure including a substantially triangular elastic fabric wall panel having a longitudinally extensible base and an apex and a flexible, substantially straight rod member affixed to said fabric by a securing means between the base and the apex so that said rod member extends toward said apex in a direction perpendicular to said base, wherein the application of a linear force along the longitudinal extent of said base causes an extension of said base and said fabric wall panel adjacent said base which results in a reduction in fabric dimension in the direction parallel to said rod member that stresses said rod member so that said rod member is deformed to a bowed shape and said securing means deflects said fabric wall panel corresponding to said rod member bowed shape and means to maintain said linear force.

3. The lightweight, portable shelter structure described in claim 2, wherein two substantially triangular fabric wall panels are joined along a side of the triangle adjacent said base so that the apices of said triangular wall sections are adjacent and the longitudinally extensible bases are positioned to extend along lowermost parts of said canopy.

4. The lightweight, portable shelter structure described in claim 2, wherein said triangular wall panel includes stabilizing means for stabilizing the edges of said triangular panels.

5. The lightweight, portable shelter structure described in claim 2, wherein said triangular wall panel includes at least one right angle.

6. The lightweight, portable shelter structure described in claim 2, wherein two said substantially triangular fabric wall panels are joined along the longitudinal extent of the bases thereof to form a canopy, and the conjoined longitudinally extensible bases are positioned so that the longest dimension of said canopy extends along an uppermost part to form a roofline of said canopy, and the application of a linear force along said longest dimension indirectly stresses said rod members, causing said rod members to bow, thereby imparting an arcuate shape to said canopy.

7. The lightweight, portable shelter structure described in claim 6, wherein said means to maintain said linear force comprises a pair of anchor means attached to said canopy, one at each end of the conjoined longitudinally extensible bases, for applying said linear force to said canopy.

8. The lightweight, portable shelter structure described in claim 6, further including an expandable floor portion attached to said canopy portion, said floor portion being designed to accomodate the full width of said canopy when said rod members are not retained by said sensing means.

9. The lightweight, portable shelter structure described in claim 8, wherein said fabric is waterproof.

10. The lightweight, portable shelter structure described in claim 8, wherein a single rod member is employed to extend between the apices of the two triangular panels of said canopy.

11. The lightweight, portable shelter structure described in claim 8, further including height adjustment means whereby occupants of the shelter can adjust the interior height of the shelter relative to the floor area.

12. The lightweight, portable shelter structure described in claim 8, wherein said expandable floor portion is loosely gathered under said canopy, thereby permitting expansion of said floor portion, 13. The lightweight, portable shelter structure described in claim 12, further including integral, sheltered ventilation means operable to induce the flow of environmental air through the interior of the shelter in a variety of weather conditions.

14. The lightweight, portable shelter structure described in claim 13, further including window means for providing ingress and egress from the interior of the shelter.

15. The shelter structure described in claim 13, wherein said ventilation means includes first vent means located near the floor portion for allowing dry, ambient air to enter the shelter interior and second vent means located near the highest point of said canopy portion when said shelter is assembled for allowing warm, moist interior air to escape from the shelter.

* * * * *